United States Patent [19]

Fraga

[11] 4,309,798

[45] Jan. 12, 1982

[54] FAIL-SAFE SLIDE FASTENER

[76] Inventor: John B. Fraga, 1486 Kolln St., Pleasanton, Calif. 94566

[21] Appl. No.: 109,793

[22] Filed: Jan. 7, 1980

[51] Int. Cl.[3] ..... A44B 19/04

[52] U.S. Cl. ..... 24/205 R; 24/205.13 R

[58] Field of Search ..... 24/205 R, 213 R, 213 D, 24/212, 216 R

[56] References Cited

U.S. PATENT DOCUMENTS

| | | | |
|---|---|---|---|
| 1,831,570 | 11/1931 | Krakowsky | 24/205.13 R X |
| 2,013,071 | 9/1935 | Sipe | 24/205 R X |
| 2,382,261 | 8/1945 | Scher | 24/205.13 R |
| 2,828,523 | 4/1958 | Morin | 24/205 R |
| 2,993,252 | 7/1961 | De Held | 24/205.13 R X |
| 3,100,325 | 8/1963 | Morin | 24/205 R X |
| 3,334,387 | 8/1967 | Gauthier | 24/205 R |
| 3,725,983 | 4/1973 | Selvaggi | 24/205 R |

*Primary Examiner*—Roy D. Frazier
*Assistant Examiner*—Peter A. Aschenbrenner
*Attorney, Agent, or Firm*—Poms, Smith, Lande & Rose

[57] ABSTRACT

A positively locking slide fastener assembly of the "zipper" type includes two trains of locking elements or teeth with each of the teeth being provided with an interlocking hook-like extension and a locking surface. Adjacent teeth in each of the two trains are oppositely directed with the hooks pointing up and down, and opposed teeth in different trains have the teeth pointing up and down for interlocking of the opposed trains. The slider for securing the trains together and for unlocking them includes camming surfaces for tilting the opposed teeth to an unlocking position as the opposed trains are brought together or unfastened. In addition, a movable or adjustable pointed element may be provided to assist in the separation of the two trains as the slide fastener assembly is opened. Camming surfaces and the pointed opening element may be secured and put into operation by movement of the slider handle to its operative position.

6 Claims, 10 Drawing Figures

FAIL-SAFE SLIDE FASTENER

FIELD OF THE INVENTION

This invention relates to slide fasteners of the "zipper" type.

BACKGROUND OF THE INVENTION

Many varieties of slide fasteners have been proposed heretofore, and two of these previously proposed slide fastener assemblies are shown in U.S. Pat. Nos. 3,725,938, granted Apr. 10, 1973, and 3,334,387 granted Aug. 8, 1967. In most of the slide fasteners or zippers which have previously been proposed, each of the successive elements or teeth in the two trains of teeth engage one another along the longitudinal axis of the zipper. One disadvantage of these slide fasteners is that occasional excessive pressure or strain applied to the zipper along its length while it is closed will open the train, and releasing the pressure on adjacent teeth or elements in the train will permit a gradually widening gap or opening in the slide fastener.

One object of the present invention is to provide a slide fastener structure in which the release of a single element along the length of the zipper will not cause unsightly gaps, or irreparable damage to the assembly.

Another object of the present invention is to provide a slide fastener assembly which is flexible and yet is positively locking in nature.

Still another object of the invention is to provide a zipper-type assembly in which individual elements along its length may be selectively opened or closed when necessary.

SUMMARY OF THE INVENTION

In accordance with one aspect of the invention, a slide fastener assembly includes two trains of hook-like elements, with successive elements or teeth in each train being reversed so that successive teeth have hooks which point up and down, or in and out, relative to the plane of the slide fastener assembly; and the hooks on the mating train are arranged in a similar manner so that the relatively wide and flat hook-like surfaces of opposed teeth or elements engage one another, with the direction of engagement being alternated in successive pairs of teeth.

In accordance with a feature of the invention, a slider for opening and closing the slide fastener assembly may including camming surfaces for tilting opposite elements or teeth up and down to tilt them away from the opposing teeth, thereby unlocking the teeth as the slide fastener is opened, or preparing the opposed elements for locking engagement as the slide fastener is being closed. In addition, a pointed or conical element may be provided to initially separate opposed pairs of teeth during the unlocking step.

The configuration of the teeth so that they tend to latch together when forced together and then are caused to open or separate when opposed teeth are forced toward one-another beyond their normal engaging position, is another feature of the invention. This feature is implemented structurally by an angled surface on the end of the teeth which is angled in the direction of the hook, and continues at the same general angle beyond the hook engagement surface, toward the root of the teeth.

Other contributory features of the invention include (1) the width of the teeth which is preferably greater than the space between the teeth to preclude unlocking by lateral movement of the teeth, (2) the advancement of certain camming surfaces as the slide fastener handle is put into use, (3) clearance behind the hook-like elements to permit free flexing of the assembly where such action is desired, (4) the provision, in the teeth or elements, of bumps on one side and depressions on the other for engagement and interaction with the camming surfaces in locking and in disengagement of the teeth, and (5) the fact that all of the elements may be identical, although employed in reverse orientation in successive teeth positions.

Advantages of the fastener include the fact that the interlocking zipper-type assembly will function with one or more broken segments, and the result that it will serve for the life of the garment or other product on which it is used. Variations in the spacing of the individual segments and the clearance provided above the broad hooks on each element will permit the fulfillment of a great variety of requirements from extreme flexibility on the one hand to stern inflexibility on the other. The low tolerances and great manufacturing allowances permitted by the simple hook-type articulation, will result in low manufacturing costs, minimal part rejection and simple assembly. The simple uncomplicated forms of the elements or teeth means that the zipper may be readily made of a variety of materials both of metal and non-metals such as plastic. Further, should the zipper be forced open without the slider mechanism, it can be closed with the fingers without resorting to drastic measures or destroying the zipper. It can be easily opened with a pin should this be necessary to release hair or the like, and then conveniently closed again.

Other objects, features and advantages will become apparent from a consideration of the following detailed description and from the accompanying drawings.

DETAILED DESCRIPTION

Figure 1:
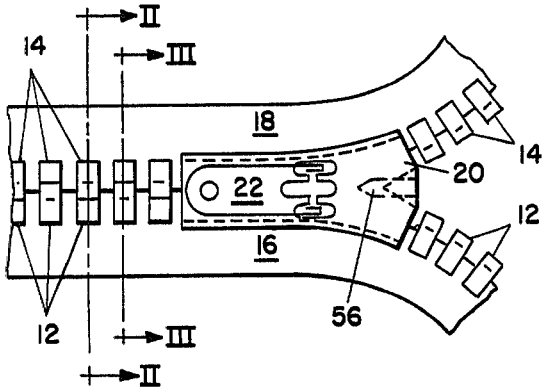
FIG. 1 is an assembly view of a slide fastener illustrating the principles of the present invention.

Referring more particularly to the drawings, the assembly view of FIG. 1 shows a slide fastener assembly including a first train of teeth or locking elements 12, and a second set or train of teeth or locking elements 14. The teeth 12 are secured to one strip of fabric 16, and the train of teeth 14 are secured to the edge of a second strip of fabric 18. The slider 20 with its pivoted handle 22 serves to open and close the slide fastener assembly as will be developed in greater detail below.

Figure 2:
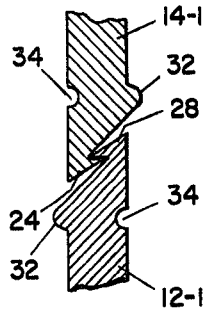
FIGS. 2 and 3 are cross-sectional views through sections II—II and III—III of FIG. 1.
Figure 3:
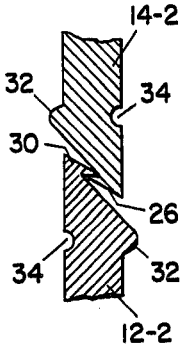

FIGS. 2 and 3 are cross-sectional views taken along lines II—II and III—III, respectively of FIG. 1. For convenience, the elements 12 and 14 which appear in FIG. 2, will be designated by 12-1 and 14-1; and those which appear in FIG. 3 will be designated 12-2 and 14-2. In considering FIGS. 2 and 3, it may be noted that the hook-like tooth or interlocking element 14-1 has its hook-like end 24 oriented in one direction, while in FIG. 3 the element 14-2 has its hook-like end 26 pointing in the opposite direction. Similarly, the hook-like end 28 of tooth 12-1 is pointing to the left in FIG. 2 and the hook 30 at the end of element 12-2 is pointing to the right in FIG. 3. Accordingly, the successive adjacent teeth in each train have their hooks pointing alternately up and down, and the interlocking between successive pairs of teeth of the two trains is first in one direction and then in the opposite direction. It may also be noted that all of the teeth are of the same configuration but are merely oriented in different directions.

It may also be noted that each of the teeth is provided with a protruberance 32 and a recess 34 adjacent the hooked end. In each case, the protruberance 32 is on the side toward which the hooked end points, and the recess 34 is on the side of the tooth from which the hooked end extends.

Figure 5:
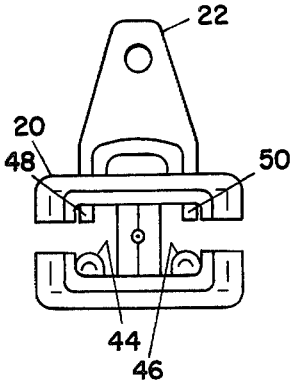
FIG. 5 is an end view of the slider of FIG. 4 from the left-hand end with the handle in the raised positions.
Figure 4:
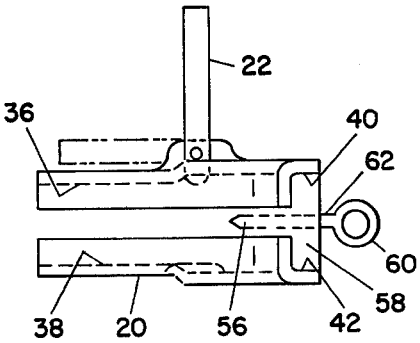
FIG. 4 is a side view of the slider element of the slide fastener assembly of FIG. 1.
Figure 6:
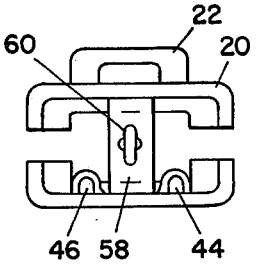
FIG. 6 is a view from the right-hand end of FIG. 4 with the handle in the retracted or folded-down position.

The purposes of the bumps or protruberances 32 and the recesses 34 will become apparent from a consideration of the configuration of the slider assembly 20 with its handle 22, as shown in detail in FIGS. 4, 5 and 6. More specifically, as shown in FIG. 4, the spacing of the upper and lower walls of the slider assembly 20 is relatively narrow at the left-hand end, as indicated by the dashed lines 36 and 38. On the other hand, at the right-hand end of the fastener where the unit is to open, the upper and lower walls 40 and 42 are spaced further apart. The camming surfaces for tilting the hooks into their open positions are shown in FIG. 5 by the elements designated by reference numerals 44 and 46, and these camming surfaces are an integral portion of the lower part of the slider assembly 20. Also shown in FIG. 5 are the camming surfaces 48 and 50 which are extensions of the side arms of the handle 22, on which the handle 22 is pivoted. By examining the positions of the protruberances 32 and the recesses 34, it may be seen that one of the opposed hook-like elements will be tilted down and the other will be tilted up, in each case in such manner as to permit hook engagement, while concurrently the movement of the slider is bringing the two trains of opposed teeth closer together, and immediately after the camming surfaces, the vertical spacing of the housing of slider 20 is reduced so that the elements are forced into locking engagement. Thus, although the slider 20 appears to be relatively simple in its configuration, each part performs a function which is structurally interrelated to that performed by each other portion of the assembly to achieve the complex desired result. As discussed below, a similar complex interaction, but reversed, occurs upon opening of the slide fastener.

Figure 7:
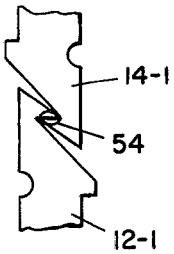
FIG. 7 is a side view of a pair of teeth, showing the recesses provided to facilitate initial separation.

Attention is also directed to FIG. 7 of the drawings, which is similar in its orientation to that of FIG. 2, but is taken from outside of elements 12-1 and 14-1, instead of being a cross-sectional view through these elements. In FIG. 7, attention is particularly directed to the conical recess 54 which is located on the mating surfaces of these two elements, and which might better be referred to as a "semi-conical" recess, in the sides of both of the two elements 12-1 and 14-1. With regard to this recess, attention is directed to the sharp pointed element 56 which appears in FIGS. 1 and 4. As the slide fastener is being opened, the point 56 engages the conical recess 54 on the matching surfaces of the elements and assures separation of the elements to supplement the camming action provided by surfaces 44, 46, 48 and 50. The pointed element 56 may be an integral part of the vertical frame element 58 (see FIG. 1) which interconnects the upper and lower portions of the slider 20; or may be movable either through threaded engagement through the frame member 58 or by attachment and movement with the handle 22. As shown in the embodiment of FIGS. 4 and 6, the pointed element 56 may be threaded and adjustable by the rotation of the eyelet 60 which is an integral part of the threaded member 62 forming the shank on which the point 56 and the loop 60 are formed.

Incidentally, with regard to the showings of FIGS. 5 and 6, it may be noted that the camming surfaces 48 and 50 are visible in FIG. 5, because the handle 22 is raised; but they are not visible in FIG. 6 because the handle 22 is lowered. Further, note that the camming surfaces 44 and 46 are permanently in position and are shown in both of the two end views of FIGS. 5 and 6.

Figure 8:
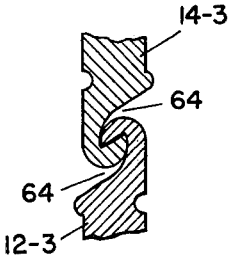
FIGS. 8 and 9 show alternative interlocking hook configurations.
Figure 9:
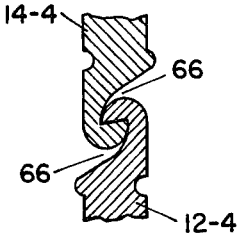

FIGS. 8 and 9 show alternative cross-sectional configurations which may be employed in place of that shown in FIG. 2 of the drawings. The angle of engagement of the two locking surfaces in FIGS. 2 and 3 is what may be called a "zero angle", that is, at right angles to the direction of stress. Using this design, tension would neither cause the segments to tend to engage nor to disengage. In FIG. 8 a substantial positive angle of articulation, which could be called a relatively deep bite, is shown. The angle in this case is in the order of 30 degrees, and it is contemplated that an even deeper bite of up to about 45 degrees or more could be employed. The substantial space shown at 64 between the elements 12-3 and 14-3 provides flexibility and avoids the need for tight tolerances. In the case of FIG. 9, a more shallow angle in the order of 5 to 15 degrees is shown as the angle of engagement between teeth 12-4 and 14-4. This slight positive angle, and relatively small clearance angle 66 includes rounded contours, and would produce about the shortest overall length of the segments or teeth. The positive angle should be slightly greater than the maximum angle of deformation under stress, in the preferred embodiments, so that for most normal applications at least a slight positive angle is maintained. It is noted, however, that for certain special applications, a sight negative angle of engagement could be employed to permit parting of the zipper at a predetermined force level.

Figure 10:
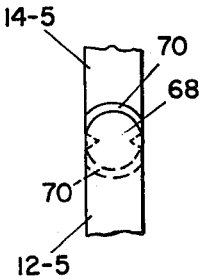
FIG. 10 shows an alternative rounded tooth or locking element configuration.

FIG. 10 is a view of an alternative embodiment of the elements 12-5 and 14-5 taken at an angle rotated 90 degrees from the showing of FIG. 9, for example, looking at the teeth of FIG. 9 from the right-hand side. In this showing, instead of having the teeth of relatively constant cross-section in planes parallel to the cross-sectional view of FIG. 9, the individual elements have rounded ends, for example, shown at 68 in FIG. 10, and may be provided with clearance of the desired magnitude, as indicated at reference numeral 70 in FIG. 10. The conical separating recesses, of the type shown at 54 in FIG. 7, are also shown by dashed lines in FIG. 10.

In conclusion, it is to be understood that the present invention is not limited to the precise structure as shown and described hereinabove. Thus, by way of example, and not of limitation, the hook-like elements making up the slide fastener may have different outer configurations, may be spaced very close together within a distance of less than 10 percent of their width to the next adjacent fastener or may be spaced apart by a distance of up to close to the width of the individual fastener elements, and the clearance angles and angles of engagement of the opposing slide fasteners may be varied widely in order to achieve the desired security and flexibility parameters. Concerning other possible variations: the teeth elements need not be identical; the slider may be provided with a double bell to close accidentally opened portions of the fastener; and the opening element 56, 60 may be spring biased in the direction of point 56, and the loop 60 used for closing, to compress the spring and retract the point during closing. Accordingly, the invention is not limited to that precisely as shown and described hereinabove.

What is claimed is:

1. A positively locking slide fastener assembly comprising:

first and second trains of locking elements, each said element being provided with an interlocking hook-like extension and locking surface;

strips of fabric for holding said trains of elements, and for securing the assembly in place;

means for mounting said trains of elements in opposed facing relationship to one another on said strips of fabric, with the adjacent elements in each train being reversed in orientation relative to one another, and with opposed elements in the two trains being oriented with their hook-like extensions pointing in the opposite directions to facilitate engagement of said locking surfaces of each pair of opposed elements;

slider means for fastening and unfastening said opposed trains of locking elements, said slider means including camming surface means for engaging said locking elements to tilt them away from their normal plane so that opposite locking elements may easily engage and disengage from one another as said slider is moved to close or open the assembly;

a movable handle secured to said slider means; and means for shifting at least certain of said camming surfaces into operative positions when said handle is moved into its operative position.

2. A positively locking slide fastener assembly comprising:

first and second trains of locking elements, each said element being provided with an interlocking hook-like extension and locking surface;

strips of fabric for holding said trains of elements, and for securing the assembly in place;

means for mounting said trains of elements in opposed facing relationship to one another on said strips of fabric, with the adjacent elements in each train being reversed in orientation relative to one another, and with opposed elements in the two trains being oriented with their hook-like extensions pointing in the opposite directions to facilitate engagement of said locking surfaces of each pair of opposed elements;

slider means for fastening and unfastening said opposed trains of locking elements, said slider means including camming surface means for engaging said locking elements to tilt them away from their normal plane so that opposite locking elements may easily engage and disengage from one another as said slider is moved to close or open the assembly; and each of said locking elements being provided with a raised portion for engaging said camming surfaces extending in the same direction as the end of the hook-like extension on each locking element, and a recess on the opposite side of each said locking element for precluding lateral pressure by said camming surfaces on the side of said locking elements where the recess is located.

3. A positively locking slide fastener assembly comprising:

first and second trains of locking elements, each said element being provided with an interlocking hook-like extension and locking surface;

strips of fabric for holding said trains of elements, and for securing the assembly in place;

means for mounting said trains of elements in opposed facing relationship to one another on said strips of fabric, with the adjacent elements in each train being reversed in orientation relative to one another, and with opposed elements in the two trains being oriented with their hook-like extensions pointing in the opposite directions to facilitate engagement of said locking surfaces of each pair of opposed elements;

slider means for fastening and unfastening said opposed trains of locking elements;

each said pair of opposed locking elements being provived with a tapered recess at one side of the mating locking surfaces; and said slider being provided with a pointed element to engage said recess to initiate separation of said pairs of locking elements.

4. A slide fastener assembly as defined in claim 3 wherein said pointed element is movable.

5. A slide fastener assembly as defined in claim 3 wherein said pointed element is adjustable.

6. A positively locking slide fastener assembly comprising:

first and second trains of locking elements, each said element being provided with an interlocking hook-like extension and locking surface;

strips of fabric for holding said trains of elements, and for securing the assembly in place;

means for mounting said trains of elements in opposed facing relationship to one another on said strips of fabric, with the adjacent elements in each train being reversed in orientation relative to one another, and with opposed elements in the two trains being oriented with their hook-like extensions pointing in the opposite directions to facilitate engagement of said locking surfaces of each pair of opposed elements;

slider means extending to opposite sides of said elements for fastening and unfastening said opposed trains of locking elements;

each said locking element including means for engaging said slider means to displace each said element away from its neutral position in the opening direction as the slider means is moved in the direction to close said slide fastener each said element or tooth having an angled surface at its end which is angled toward the point of said hook, to facilitate locking of said elements; and each said element or tooth having an additional angled surface adjacent said hook toward the root of said element or tooth extending in the same direction as the other angled surface, to facilitate opening of said teeth upon forcing said teeth together beyond the normal closed position.

* * * * *